US006758023B1

(12) United States Patent
Sorkin

(10) Patent No.: US 6,758,023 B1
(45) Date of Patent: Jul. 6, 2004

(54) EXPANSION DOWEL SYSTEM AND METHOD OF FORMING SAME

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 0 days.

(21) Appl. No.: 10/041,880

(22) Filed: Jan. 10, 2002

(51) Int. Cl.[7] ..... E04B 1/62
(52) U.S. Cl. ..... 52/704; 52/585.1; 52/583.1
(58) Field of Search ..... 52/704, 396.02, 52/396.04, 583.1, 585.1; 404/52, 59, 60, 63; 220/613, 612, 309.1, 310.1

(56) References Cited

U.S. PATENT DOCUMENTS 1,946,658 A * 2/1934 Angier ..... 404/59
2,149,291 A * 3/1939 Hofwolt ..... 404/60
2,208,005 A * 7/1940 Krumholtz ..... 404/60
2,572,552 A * 10/1951 Willard ..... 404/60
3,868,036 A * 2/1975 Wittwer ..... 215/12
5,216,862 A * 6/1993 Shaw et al. ..... 52/396.02
5,628,579 A 5/1997 Forster
5,797,231 A * 8/1998 Kramer ..... 52/396.02
5,931,619 A 8/1999 Hartmann

* cited by examiner

*Primary Examiner*—Carl D. Friedman
*Assistant Examiner*—Basil Katcheves
(74) *Attorney, Agent, or Firm*—Harrison & Egbert

(57) ABSTRACT

An expansion dowel system including a dowel bar and a polymeric sleeve affixed over the dowel bar. The sleeve has a closed end and an open end. The closed end is heat sealed and liquid tight. The sleeve has a tapered portion extending toward the closed end and from a tubular portion of the sleeve. The tapered portion has a first flat surface and a second flat surface heat sealed together at the closed end. The dowel bar has an end abutting the narrowing interior of the tapered portion. The dowel bar has an end extending outwardly of the open end of the sleeve. The dowel bar and the sleeve are positioned in a first pour of concrete while an opposite end of the dowel bar is positioned in an adjacent second pour of concrete.

7 Claims, 2 Drawing Sheets

EXPANSION DOWEL SYSTEM AND METHOD OF FORMING SAME

BACKGROUND OF THE INVENTION

1. Technical Field

The present invention relates to expansion dowel systems. More particularly, the present invention relates to construction joints for transferring stresses across a joint between concrete constructions. More particularly, the present invention relates to the use of polymeric sleeves extending around a portion of a rigid dowel bar within the concrete construction.

2. Description of Related Art

Concrete responds to changes in temperature and moisture when movement associated with these changes (or for other reasons such as internal chemical reaction) is restrained. In these instances, stresses develop that can lead to cracking. To control cracking, joints are built at interval distances short enough to maintain stresses below critical values. Transverse joints are saw cut, placed through induced cracking, or formed at pre-determined spacings.

Concrete pavements for highways, airport runways and the like are generally placed in strips or lanes with a longitudinal joint formed between adjacent strips or lanes. Concrete is poured in the first strip and allowed to cure. Subsequently, concrete is poured and cured in the adjacent strip and so on until the concrete pavement is completed. A longitudinal joint is formed between adjacent strips to facilitate construction and to reduce stresses and control cracking caused by contraction or expansion of the concrete. Transverse or slug joints are also formed in concrete by cutting or sawing the concrete at a given location and to a given depth.

Similarly, joints are formed in concrete structural slabs, walls, footings and the like to minimize stresses and/or simplify construction methods. Of these joints, there are several types. For example, the expansion joint provides a space between slabs to allow for expansion or swelling of the slab as temperature and moisture increase or grow occurs. A construction joint provides a finished edge or end so that construction operations interrupted for some length of time may be continued or resumed without serious structural penalty.

Load is transferred across a joint principally by shear. Some bending moment may be transferred across the joints through tie joints. Good load transfer capability must be built into the joint or the load carrying ability of the concrete slab or structure will be reduced. The alternative is to strengthen the concrete by improving support or increasing depth to minimize the joint load transfer weakness.

Tie bars and dowels are often used in concrete design to improve load transfer at the joint between concrete slabs or structures. Such tie bars and dowels are embedded in the concrete and arranged across the joint in a direction substantially perpendicular to the axis defined by the joint. Various approaches, depending on the type of tie bar or dowel, have been suggested with respect to concrete construction joints.

In the construction of concrete slabs on grade, it is common practice to install continuous side forms with dowels for future adjacent slab concrete placement and to place concrete in long continuous strips. It is also known to place slab dowels and sleeves at specified distances across the strips to allow the strips to have a controlled plane to accommodate shrinkage of the concrete. The positions of these dowel locations are marked on the side forms and the concrete after placement and finishing is struck to provide a joint at these locations.

The functions of the tie bars and dowels are to keep contiguous sections of concrete in alignment during contraction and expansion, and to transfer shear stresses and bending moments across the joint between the two slabs.

FIG. 1 shows a typical dowel bar sleeve assembly which is used in a concrete structure. As depicted in FIG. 1, sleeve dowel bar assemblies are embedded in the first concrete slabs, and arranged across the transverse transfer joint 22*a* to 22*e* and 23*a* to 23*e*, in a direction substantially perpendicular to the axes defined by the transverse transfer joint. Similarly, dowel sleeves are embedded in the first concrete slabs and arranged across the joint in a direction substantially perpendicular to the axes defined by the longitudinal transfer joint 24*a* to 28*a*, etc. In a typical installation sleeve, dowel bar assembly 32 is positioned on the rebar-matrix and the concrete slab is poured. The concrete slab is allowed to harden in situ with the dowel bars and dowel sleeves embedded therein.

After the first concrete slab has undergone expansion or contraction from thermal or drying shrinkage, the second concrete slab is placed adjacent to the first concrete slab after the dowel bars are inserted into the sleeves previously placed in the prior concrete pour so that the dowel bars are also essentially embedded in the second concrete slabs. The second concrete slab will attempt to shrink during curing in a similar manner to the shrinkage of the first concrete slab.

In a conventional installation, the dowel bars arranged across longitudinal joints between the first and second concrete slabs will attempt to restrain the second concrete slabs from movement. The developed and internal stress in the second concrete slab can create an added stress which may cause cracking by itself or when added to an applied load upon the slabs. The cracks will often develop along a line near the ends of the dowels bars. Referring now to FIG. 1, an illustrative reinforced concrete slab section 10 is shown which includes two versions of the concrete dowel slab joint system in place of the conventional dowel bars previously discussed. In a first version, denoted 18, a dowel bar 20 is positioned within a single sleeve body 32. This first version is used to bridge longitudinal joints, for example, the joints formed between adjacent slab segments 12*a*, 14*a*, 16*a*, etc. In a second version, denoted 19, a dowel bar 20 is positioned within the confines of a pair of sleeves 32. The second version is employed to bridge transverse joints 22*a*, 22*b*, 22*c*, etc. A reinforced concrete slab section 10 comprises a concrete slab and may include an interconnected matrix of reinforcing re-bar rods (not shown). The matrix of reinforcing re-bar rods are arranged in a predetermined pattern according to known principals of structural engineering.

In the past, various U.S. patents have issued relating to such expansion dowel systems. In particular, U.S. Pat. No. 5,797,231, issued on Aug. 25, 1998 to D.R. Kramer, describes a concrete dowel slab joint system for maintaining adjacent sections of concrete, and alignment during contraction and expansion of the concrete, and for transferring shear stresses and bending moments across a joint formed between adjacent concrete slabs. This system includes a sleeve assembly for receiving and maintaining the dowel bar there within. As a result, the dowel bar will not transmit substantial shear stresses to the concrete during the contraction and expansion of the concrete. The sleeve assembly comprises an elongate sleeve body having an outer surface and an inner surface and defines a hollow interior compartment. The sleeve assembly uses a collapsible spacer member located within the hollow interior compartment.

U.S. Pat. No. 5,628,579, issued on May 13, 1997 to H. Forrester, describes an expansion dowel which includes an expansion sleeve and an expanding member. The expansion sleeve is provided with a bore tapering in the setting direction as well as with an open ended longitudinal slot. The expanding member has a blind bore open towards the setting side and has a lug projecting from the same at its opposite end. The cross-sections of the lug and the blind bore are matched to one another so that a rated break point or failure point is formed.

U.S. Pat. No. 5,931,619, issued Aug. 3, 1999 to M. Hartmann, describes an expansion dowel formed of an axially extending expansion sleeve with a through bore and an expansion region having at least one axially extending slot, and an expanding member axially displaceable by axially directed blows in the through bore from an initial position to an end position in which the expansion region is expanded The through bore has an inside surface of the expansion region adjacent to an envelope or outside surface of the expanding member in the end position with radius of curvature of the inside surface being basically the same as the radii of curvature of the envelope surface of the expanding member.

Conventionally, the prior art dowel bar sleeves are formed of a single tubular member, such as those sold by Shepler's. The plastic tubing used for these dowel sleeves is cut to the desired size, and then the open end of the tube is stapled together. It has been found that stapling of the end of the dowel sleeve will not prevent water intrusion into the interior of the sleeve. Often, this stapling is difficult to perform and will inadequately secure the end of the tube together. The stapling requires a manual operation which requires expensive labor to complete. Alternatively, the tube is provided with a cap. The cap must be injected molded so as to properly fit the end of the tube. The injection molding of the cap is a relatively expensive procedure. Often, the cap will not properly fit the end of the tube. In other circumstances, the cap will be improperly assembled on the end of the sleeve so that liquid intrusion can occur.

It is an object of the present invention to provide a sleeve for a dowel bar which is relatively inexpensive.

It is another object of the present invention to provide a sleeve for a dowel bar which prevents water intrusion into the interior of the sleeve.

It is still a further object of the present invention to provide an expansion dowel system whereby the dowel bar is centered within the interior of the sleeve.

It is still a further object of the present invention to provide an expansion dowel system which is easy to use and requires no assembly.

It is still a further object of the present invention to provide an expansion dowel system which minimizes the possibility of human error during installation.

These and other objects and advantages of the present invention will become apparent from a reading of the attached specification and appended claims.

BRIEF SUMMARY OF THE INVENTION

The present invention is an expansion dowel system comprising a dowel bar and a polymeric sleeve affixed over the dowel bar. This sleeve has a closed end and an open end. The closed end is heat sealed and liquid tight. The sleeve has a tubular portion extending to the open end. The sleeve has a tapered portion extending to the closed end. The tapered portion has a first flat surface and a second flat surface heat sealed together at the closed end. The tapered portion has a narrowing interior extending from the tubular portion to the closed end.

The dowel bar has an end abutting the narrowing interior of the tapered portion. The dowel bar extends centrally through the sleeve and is generally spaced from an interior wall of the sleeve. The dowel bar has an end extending outwardly of the open end of the sleeve.

A first pour of concrete extends over and around the sleeve. The dowel bar has an end extending outwardly of the first pour of concrete. A second pour of concrete is adjacent to the first pour of concrete. The end of the dowel bar extends into this second pour of concrete. The second pour of concrete has an edge extending in parallel relationship to an edge of the first pour of concrete. The dowel bar on the sleeve extends transverse to these edges. Each of the first and second pours of concrete are placed upon an underlying surface. A chair is positioned on the underlying surface and extends upwardly therefrom. The sleeve is secured to a top surface of the chair.

The present invention is also a method of forming a sleeve used with the dowel bar in concrete construction. This method includes the steps of: (1) forming a tubular member of a polymeric material having an open end: (2) collapsing an area adjacent an end of the tubular member so as to form a tapered section of narrowing interior diameter; and (3) heat-sealing the opposite end of the tubular member so as to form a closed end of the tubular member. The collapsed end can be formed by compressing the opposite end together by the use of a heated member so that the surfaces at the opposite end are welded together by the heated member. Alternatively, the collapsing of the opposite end can be carried out through a vacuum forming process.

DETAILED DESCRIPTION OF THE INVENTION

Figure 1:
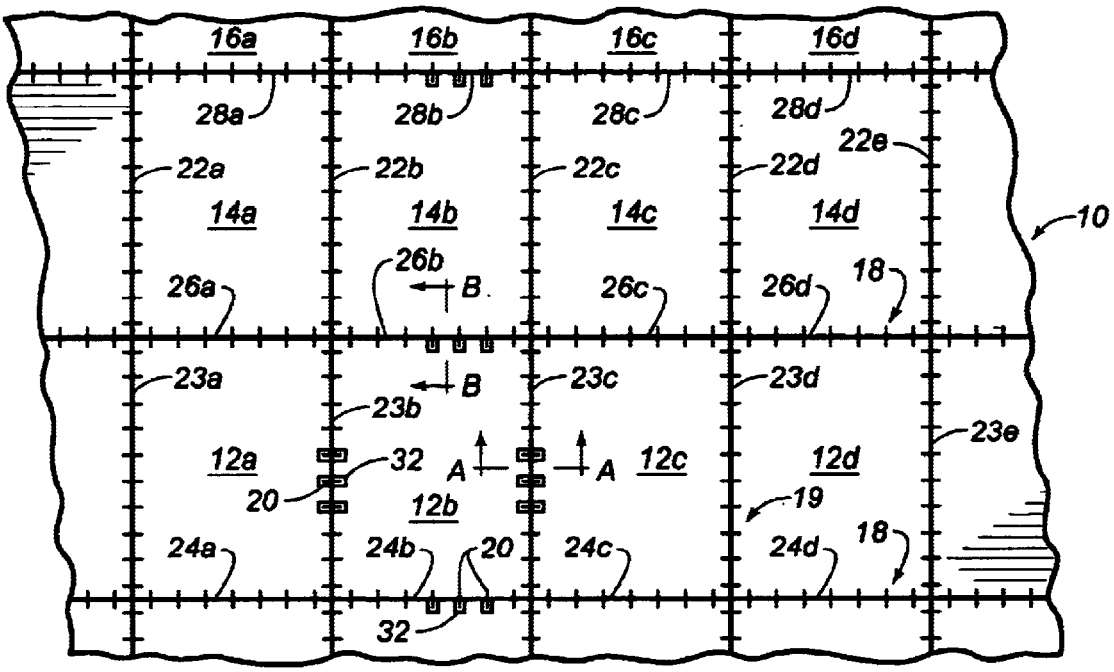
FIG. 1 Prior Art
FIG. 1 is a plan and diagrammatic illustration of the prior art use of expansion dowels and associated sleeves.
Figure 2:
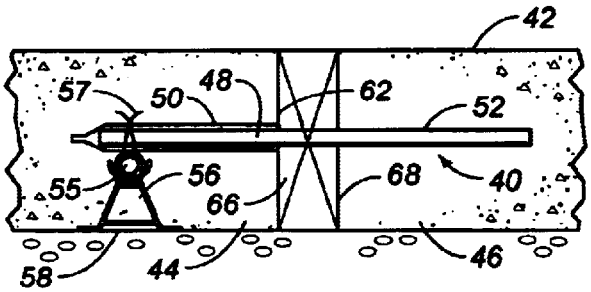
FIG. 2 is a transparent view showing the use of the expansion dowel system of the present invention within concrete.

In FIG. 2, the expansion dowel system 40 of the present invention is illustrated as embedded within the concrete 42. The concrete 42 includes a first pour of concrete 44 and a second pour of concrete 46. The dowel bar 48 and the sleeve 50 are embedded within the first pour of concrete 44. The opposite end 52 of the dowel bar 48 is embedded within the second pour of concrete 46.

As can be seen in FIG. 2, a reinforcing rebar rod 55 is held in position on a chair 56 positioned above an underlying surface 58. The first pour of concrete 44 is placed upon the underlying surface 58. Similarly, the second pour of concrete 46 is also placed upon the underlying surface 58. The chair 56 is one of any number of concrete construction chairs which can serve to support the rebar 55 in its proper position above the underlying surface 58. The rebar 55 is held in place by a wire tie 57. The rebar 55 is maintained at a predetermined relative height by the chair 56. The rebar rod 55 is held in position atop the chair 56 by the wire ties 57. Similarly, the sleeve 50 over the dowel bar 48 is held in a desired position over the rebar 55 through the use of the wire ties 57. The first pour of concrete 44 is then poured over the underlying surface 58, over the chair 56, over the rebar 55 and over the sleeve 50. At the time of the pour, the dowel bar can extend through the sleeve 50 or can be separated therefrom. The open end of the sleeve 50 will open to the edge 62 facing the second pour of concrete 46. Space 66 is illustrated in an exaggerated fashion so as to indicate that there is a small space which exists between the edge 62 of the first pour of concrete 44 and the edge 68 of the second pour of concrete 46. The edge 62 and the edge 68 are in longitudinally parallel relationship. After the first pour of concrete 44 is cured, the form board placed along the edge 62 can be removed so as to expose the open interior of the sleeve 50. The dowel bar 48 can be inserted into the open end of the sleeve 50 so as to extend outwardly of the edge 62. The second pour of concrete 46 can then be poured around the opposite end 52 of the dowel bar 48 and be cured thereover.

The construction joint 66 will be located between the edges 62 and 68 of the respective first and second concrete slabs. In use, the dowel bar 48 remains in position. When substantial expansion and contraction of the concrete slabs 44 and 56 occurs, the dowel bar 48 will move in response to the expansion and contraction of the concrete slabs so as to move the dowel bar 48 in a lateral and/or longitudinal path within the interior of the sleeve 50. Thus, when interactive forces are exerted upon the dowel bar 48 located within the sleeve 50, the dowel bar 48 does not transmit substantial shear stresses to the concrete during a contraction and expansion of the concrete.

Figure 3:
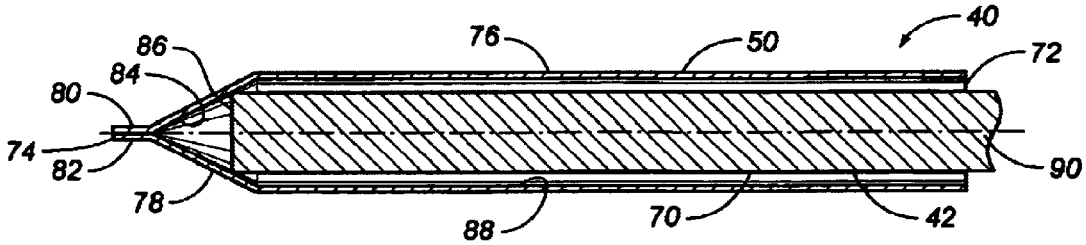
FIG. 3 is a cross-sectional view showing the dowel bar as placed within a sleeve of the present invention.

FIG. 3 shows the expansion dowel system 40 of the present invention. As can be seen, the dowel bar 42 is positioned within the interior 70 of the sleeve 50. The sleeve 50 is formed of a polymeric material and is affixed over and around the dowel bar 42. The sleeve 50 has an open end 72 and a closed end 74. The closed end 74 is heat sealed and liquid tight.

Figure 6:
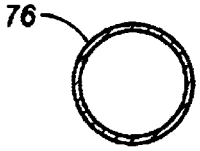
FIG. 6 is a cross-sectional view of the sleeve of the present invention as taken across lines 6–6 in FIG. 4.

The sleeve 50 has a tubular portion 76 extending to the open end 72. The sleeve 50 also has a tapered portion 78 extending to the closed end 74 from an end of the tubular portion 76. The tubular portion 76 is of a generally constant diameter and has a circular cross-section (as shown in FIG. 6). The tapered portion 78 has a first flat surface 80 and a second flat surface 82 heat sealed together at the closed end 74. The tapered portion 78 has a narrowing interior 84 extending from the tubular portion 76 to the closed end 74.

In the present invention, the dowel bar 42 is formed of a rigid material. The dowel bar has an end 86 abutting the narrowing interior 84 of the tapered portion 78. As can be seen, the dowel bar 72 extends generally centrally through the sleeve 50 and is generally spaced slightly from the interior wall 88 of the tubular portion 76. The tapered portion 78, as used in the present invention, assures a generally centrally oriented dowel bar 42. When the dowel bar 42 is introduced through the open end of the sleeve 50, it will travel through the interior of the tubular portion 76 until it meets the tapered portion 78. The tapering interior surface 84 of the tapered portion 78 will have a "centralizing effect". The dowel bar 42 will have an end 90 extending outwardly of the open end 72 of the sleeve 50. In the preferred embodiment of the present invention, the sleeve 50 will have a length no less than four inches long.

In the present invention, the tubular portion 76, the tapered portion 78 and the heat sealed end 78 are integrally formed together of a polymeric material.

Figure 4:
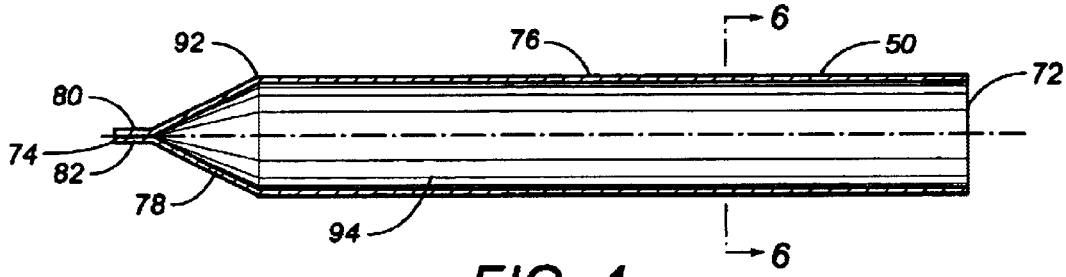
FIG. 4 is an isolated cross-sectional view of the sleeve in accordance with the present invention.

FIG. 4 is an isolated view showing the sleeve 50 of the present invention. In FIG. 4, it can be seen that the sleeve 50 has its open end 72 at one end and its heat sealed end 74 at the opposite end. The sleeve 50 has tubular portion 76 extending for most of the length of the sleeve 50. The tapered portion 78 is located at the end 92 of the tubular portion 76 so as to extend toward the heat sealed closed end 74. The walls of the tapered portion 78 will be generally collapsed so as to lead to the flat surfaces 80 and 82 at the heat sealed end 74. The heat sealing at the surfaces 80 and 82 at the end 74 will prevent liquid intrusion into the interior of the tubular portion 76. Additionally, the heat sealing of the end 74 will provide an integral structure which does not require assembly at the work site. The heat sealing at the end 74 avoids the problems associated with the stapling of a tubular sleeve or the extra labor and cost associated with the formation of and the placement of a cap over the end of a tubular sleeve. As used herein, the term "heat sealed" includes welding, melting together, forming together and ultrasonic welding.

Figure 5:
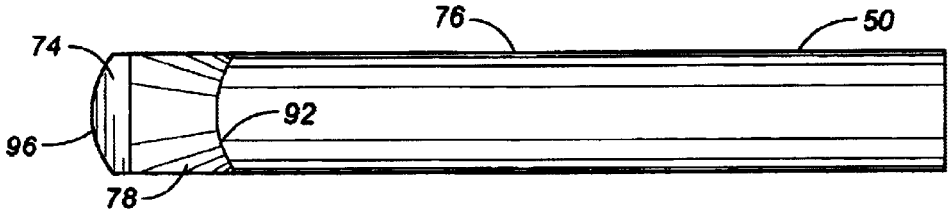
FIG. 5 is a plan view of the sleeve as used in accordance with the present invention.

FIG. 5 shows the sleeve 50 from a plan view. The sleeve includes the tubular portion 76, the tapered portion 78 and the heat sealed end 74. It can be seen that the heat sealed end 74 has a generally curved end surface 96. Similarly, the end 92 of the tubular portion 76 will be curved.

FIG. 6 shows that the tubular portion 76 has a circular cross-sectional area. However, it should be noted that, within the concept of the present invention, the tubular portion 76 could be of a square or rectangular construction so as to accommodate rectangular cross-sectioned dowel bars.

Importantly, the present invention provides a simplified construction of a sleeve for an expansion dowel system. In the present invention, the tubular portion 76 can be formed by simple extrusion processes. The tapered portion 78 can be formed by simply collapsing the end of the tubular portion 76. The heat sealed ends 74 can be formed by the application of a heated compressive force to the ends of the tapered portion 78. Within the method of the present invention, the extrusion of the tubular portion 76 can be carried out on a continuous basis. For example, various lengths of tubes can be cut during a continuous process so as to form a single tubular member. A heated compressive force, such as the dies of a press, can be applied to the end 74 of the tubular portion 76 so as to heat seal the end 74 together. The tapered portion 78 will be automatically formed by the collapsing of the end of the sleeve 50. The compressive heat sealing of the end 74 can be carried out after the extruded tube has been formed.

Alternatively, the collapsed, tapered section 78 can be formed by vacuum forming the end 74. The end 74 can be simply pinched together such that the flat surfaces 80 and 82. Still further, and alternatively, the sleeve 50 can be formed by a corrugation machine. Blocks will move in correspondence so as to form the tubular portion 78. Periodically, a block will have an interior configuration which molds and directly forms the tapered section 78 and heat seals the end 74 together.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An expansion dowel system comprising:

a dowel bar; and a polymeric sleeve affixed over said dowel bar, said sleeve having a closed end and an open end, said closed end being heat sealed and liquid-tight, said sleeve having a tubular portion extending to said open end, said sleeve having a tapered portion extending to said closed end, said tapered portion being integral with said sleeve, said tapered portion having a narrowing interior extending from said tubular portion to said closed end, said dowel bar having an end abutting said narrowing interior of said tapered portion, said dowel bar extending centrally through said sleeve and being generally spaced from an interior wall of said sleeve.

2. The system of claim 1, said tapered portion having a first flat surface and a second flat surface heat sealed together at said closed end.

3. The system of claim 1, said dowel bar having an end extending outwardly of said open end of said sleeve.

4. The system of claim 3, further comprising:

a first pour of concrete extending over and around said sleeve, said dowel bar having said end extending outwardly of said first pour of concrete.

5. The system of claim 4, further comprising:

a second pour of concrete adjacent to said first pour of concrete, said end of said dowel bar extending into said second pour of concrete.

6. The system of claim 5, said second pour of concrete having an edge extending in parallel relationship to an edge of said first pour of concrete, said dowel bar and said sleeve extending transverse to said edges.

7. The system of claim 6, each of said first and second pours of concrete being placed upon an underlying surface, the system further comprising:

a chair positioned on said underlying surface and extending upwardly therefrom, said sleeve secured to a top surface of said chair.

* * * * *